US009427052B2

(12) United States Patent
Yamagishi et al.

(10) Patent No.: US 9,427,052 B2
(45) Date of Patent: Aug. 30, 2016

(54) SLIDER FITTED WITH STOPPING MECHANISM

(75) Inventors: Koji Yamagishi, Toyama (JP); Keiichi Keyaki, Toyama (JP)

(73) Assignee: YKK Corporation (JP)

( * ) Notice: Subject to any disclaimer, the term of this patent is extended or adjusted under 35 U.S.C. 154(b) by 189 days.

(21) Appl. No.: 14/368,459

(22) PCT Filed: Dec. 27, 2011

(86) PCT No.: PCT/JP2011/080291

§ 371 (c)(1),
(2), (4) Date: Jun. 24, 2014

(87) PCT Pub. No.: WO2013/098961

PCT Pub. Date: Jul. 4, 2013

(65) Prior Publication Data

US 2014/0331460 A1 Nov. 13, 2014

(51) Int. Cl.
*A44B 19/30* (2006.01)

(52) U.S. Cl.
CPC ..... *A44B 19/30* (2013.01); *A44B 19/306* (2013.01); *Y10T 24/2571* (2015.01)

(58) Field of Classification Search
CPC A44B 19/306; A44B 19/308; Y10T 24/257; Y10T 24/2571
See application file for complete search history.

(56) References Cited

U.S. PATENT DOCUMENTS 3,945,090 A * 3/1976 Fukuroi ..... A44B 19/306 24/421
4,102,022 A * 7/1978 Aoki ..... A44B 19/308 24/421
4,287,646 A 9/1981 Kanzaka
5,535,492 A * 7/1996 Lai ..... A44B 19/306 24/420
5,884,373 A * 3/1999 Kawamura ..... A44B 19/306 24/419
2004/0231114 A1* 11/2004 Iwase ..... A44B 19/306 24/424

FOREIGN PATENT DOCUMENTS

| | | | |
|---|---|---|---|
| GB | 2453399 | A | 4/2009 |
| JP | 37-32357 | Y1 | 12/1962 |
| JP | 45-7842 | Y1 | 4/1970 |
| JP | 5361203 | | 5/1978 |
| JP | 125701/1979 | | 9/1979 |
| JP | 86511/1980 | U | 6/1980 |
| JP | 3125222 | U | 9/2006 |
| JP | 3143517 | U | 7/2008 |

OTHER PUBLICATIONS

International Search Report, PCT Application No. PCT/JP2011/080291, mailed Mar. 13, 2012.

* cited by examiner

*Primary Examiner* — Robert J Sandy
(74) *Attorney, Agent, or Firm* — Kilpatrick Townsend & Stockton LLP

(57) ABSTRACT

A slider provided with a stopping mechanism has a press molded slider body and a stopping pawl body. The stopping pawl body has a main body, a pawl portion extending from one end side of the main body, an extending portion extending from the other end side of the main body, and a projecting portion projecting from a tip portion of the extending portion, and the extending portion has a rotation support part of the stopping pawl body. A contact surface with which the rotation support part of the upper blade is in contact is formed into a flat surface. According to this constitution, a defect and failure of the stopping mechanism hardly occur in the slider, so that the stopping mechanism can be stably operated for a long period of time.

7 Claims, 11 Drawing Sheets

SLIDER FITTED WITH STOPPING MECHANISM

This application is a national stage application of PCT/JP2011/080291, which is incorporated herein by reference.

TECHNICAL FIELD

The invention relates to a slider for a slide fastener provided with a stopping mechanism using a stopping pawl body and relates particularly to a slider whose slider body is molded by press working and in which the stopping mechanism can be stably operated.

BACKGROUND ART

The slide fastener is attached to an opening of clothing or a bag, for example, and left and right element rows are meshed or separated by sliding a slider, whereby clothing, a bag, or the like can be easily opened and closed. Regarding the sliders used for the slide fastener, there has been known the slider which has a stopping mechanism capable of maintaining a stopped state of the slider when the slider is stopped with respect to the element row.

Examples of such a slider provided with a stopping mechanism are disclosed in Japanese Examined Utility Model Application Publication No. 45-7842 (Patent Document 1) and Japanese Unexamined Utility Model Application Publication No. 53-61203 (Patent Document 2).

A slider 100 provided with a stopping mechanism described in the Patent Document 1 has a slider body 110, a tab 106 having an attaching shaft portion 107, a stopping pawl body 120 assembled on the slider body 110, and a cover body 130 holding the attaching shaft portion 107 of the tab 106 and, at the same time, storing the stopping pawl body 120 inside, as shown in FIG. 16.

In the slider 100, the slider body 110 has upper and lower blades 111 and 112, a diamond 113 connecting front ends of the upper and lower blades 111 and 112, flange portions 114 arranged at left and right side edge portions of the upper and lower blades 111 and 112, forward and rearward columns 115 and 116 provided upright on the upper blade 111, and front and rear protuberances 117 extending inside from the forward and rearward columns 115 and 116 along a slider length direction.

Further, an element guide passage is formed between the upper and lower blades 111 and 112 of the slider body 110, and the upper blade 111 is provided with a pawl hole 118 extending through the upper blade 111 in a height direction of the slider 100 and a recess 119 into which a portion of the stopping pawl body 120 fitted. Furthermore, a fitting portion into which a portion of the cover body 130 is fitted is formed at each of the front ends (front surface side of the diamond 113) and the rear end of the slider body 110.

The stopping pawl body 120 has a resilient piece 121 disposed to be inclined upward toward the rear of the stopping pawl body 120, left and right projecting pieces 122 arranged at a lower end of a front end and extending outward along a width direction of the slider 100, and a pawl portion 123 provided perpendicularly at a rear end. The pawl portion 123 of the stopping pawl body 120 is formed to be capable of advancing into the element guide passage through the pawl hole 118 of the slider body 110. The stopping pawl body 120 is positioned with respect to the slider body 110 by being covered on the front and rear protuberances 117 in the slider body 110 and, at the same time, inserting the left and right projecting pieces 122 into the recess 119 of the slider body 110.

The cover body 130 has a box-shaped cover main body and first and second attaching pieces 131 and 132 provided perpendicularly from front and rear ends of the cover main body, and the cover main body has a notched tab holding portion (space portion) for holding the attaching shaft portion 107 of the tab 106.

In the cover body 130, the forward and rearward columns 115 and 116 of the slider body 110 are stored in the cover main body, and, at the same time, the first and second attaching pieces 131 and 132 are fitted in the fitting recesses of the slider body 110, whereby the cover body 130 is attached to the slider body 110.

When the slider 100 of the Patent Document 1 is assembled, the attaching shaft portion 107 of the tab 106 is placed on the upper blade 111 of the slider body 110, and the stopping pawl body 120 is further placed on it. At this time, the stopping pawl body 120 is disposed to cover the protuberances 117 of the slider body 110, and, at the same time, the projecting piece 122 of the stopping pawl body 120 is inserted into the recess 119 of the slider body 110, whereby the stopping pawl body 120 is positioned with respect to the slider body 110. The pawl portion 123 of the stopping pawl body 120 is inserted into the pawl hole 118 of the slider body 110.

After that, the cover body 130 is mounted on the slider body 110 on which the attaching shaft portion 107 of the tab 106 and the stopping pawl body 120 are placed, whereby the slider 100 provided with the stopping mechanism is assembled. In the slider 100 of the Patent Document 1 thus assembled, since a movable range of the stopping pawl body 120 pressed by the resilient piece 121 is regulated by the protuberances 117 of the slider body 110, an advancing length of the pawl portion 123 advancing the element guide passage is limited to a certain size.

Thus, in the slider 100 of the Patent Document 1, when the tab 106 is not operated, the pawl portion 123 of the stopping pawl body 120 advances into the element guide passage by a predetermined length to engage with a fastener element, whereby the stopping mechanism of the slider 100 can be effectively operated. When the slider 100 is slid by pulling the tab 106, the stopping pawl body 120 is lifted up by the attaching shaft portion 107 of the tab 106, and the pawl portion 123 exits from the element guide passage; therefore, the slider 100 can be smoothly slid along an element row.

Meanwhile, a slider 140 provided with a stopping mechanism described in the Patent Document 2 has a slider body 150, a tab 146 having an attaching shaft portion 147, a stopping pawl body 142 assembled on the slider body 150, a resilient member 149 provided with a tongue piece resiliently pressing the stopping pawl body 142, and a cover body 160 holding the attaching shaft portion 147 of the tab 146 and, at the same time, storing the stopping pawl body 142 and the resilient member 149 inside, as shown in FIGS. 17 and 18.

In the Patent Document 2, the slider body 150 has upper and lower blades 151 and 152, a diamond 153 connecting front ends of the upper and lower blades 151 and 152, and flange portions 154 arranged at left and right side edge portions of the upper and lower blades 151 and 152.

The slider body 150 is molded by press-working a metal plate, and on a upper surface side of an upper blade 151, it is difficult to provide a projection formed by, for example, die cast molding, such as the forward and rearward columns 115 and 116 and the front and rear protuberances 117 provided in the slider body 110 of the Patent Document 1 described above.

Further, an element guide passage is provided between the upper and lower blades 151 and 152 of the slider body 150, and the upper blade 151 is provided with a pawl hole 155 extending through the upper blade 151 in a slider height direction and a recess 156 into which one end of the stopping pawl body 142 is fitted. Furthermore, a recess groove portion 157 into which a portion of the cover body 160 is inserted to be engaged is provided at a front end of the slider body 150.

The stopping pawl body 142 has a main body provided across the attaching shaft portion 147 of the tab 146, a fitting portion provided at one end (front end) of the main body and fitting into the recess 156 of the slider body 150, and a pawl portion 143 provided at the other end (rear end) of the main body and inserted into the pawl hole 155 of the slider body 150.

The cover body 160 has a box-shaped cover main body 161, a first attaching piece 162 provided perpendicularly from the front end of the cover main body 161 and a second attaching piece 163 provided perpendicularly from the rear end of the cover main body 161, and the cover main body 161 has a notched tab holding portion (space portion) for holding the attaching shaft portion 147 of the tab 146. Further, holding groove portions 164 engaging/attaching to hold the resilient member 149 are formed in an inner surface of a front wall portion and an inner surface of a rear wall portion of the cover main body 161.

When the slider 140 of the Patent Document 2 is assembled, the resilient member 149 is first attached to an inside of the cover body 160 and then held. Next, the attaching shaft portion 147 of the tab 146 and the stopping pawl body 142 are sequentially placed on the upper blade 151 of the slider body 150. At this time, the fitting portion of the stopping pawl body 142 is inserted into the recess 156 of the slider body 150, whereby the stopping pawl body 142 is positioned with respect to the slider body 150. Further, the pawl portion 143 of the stopping pawl body 142 is inserted into the pawl hole 155 of the slider body 150.

Subsequently, the slider body 150 on which the attaching shaft portion 147 of the tab 146 and the stopping pawl body 142 are placed is covered with the cover body 160 holding the resilient member 149, and moreover, a tip portion of the second attaching piece 163 in the cover body 160 is caulked to be bent inward, whereby the cover body 160 is attached to the slider body 150. According to this constitution, the slider 140 of the Patent Document 2 is assembled.

In the slider 140 of the Patent Document 2, the slider body 150 is molded by press-working a metal plate, as described above, and even when the projection is not provided on an upper surface side of the upper blade 151, the stopping pawl body 142 can be attached to the slider body 150 at a predetermined position; therefore, the slider 140 can be easily assembled.

Further, in the slider 140 of the Patent Document 2, since the stopping pawl body 142 is held rotatably (or slidably) with a portion fitted into the recess 156 of the upper blade 151 as a fulcrum, the stopping pawl body 142 is lifted by operating the tab 146, whereby the pawl portion 143 of the stopping pawl body 142 can be easily exited from the element guide passage. When the operation of the tab 146 is terminated, the stopping pawl body 142 receives a pressing force (biasing force) from the resilient member 149 to make the pawl portion 143 advance into the element guide passage; therefore, the stopping mechanism can be operated.

CITATION LIST

Patent Documents

Patent Document 1: Japanese Examined Utility Model Application Publication No. 45-7842

Patent Document 2: Japanese Unexamined Utility Model Application Publication No. 53-61203

SUMMARY OF THE INVENTION

Problems to be Solved by the Invention

When the slider body 150 is molded by press working as in the slider 140 described in the Patent Document 2, the press molded slider body 150 is often constituted of a metal material such as copper alloy and has an advantage that the corrosion resistance is better than that of a slider body obtained by die-cast molding of a metal material such as zinc alloy. In the press molded slider body 150, in general, since the slider body 150 is easily deflected when receiving stress, occurrence of breakage of the slider body 150 such as chipping and cracking is suppressed, and the slider body 150 is highly durable.

Meanwhile, when the slider body 150 is press molded, as described above, it is difficult for the upper blade 151 to provide a projection such as the forward and rearward columns 115 and 116 and the front and rear protuberances 117 provided in the slider body 110 of the Patent Document 1. Thus, in the conventional press molded slider body 150, the recess 156 is provided on the upper surface side of the upper blade 151 instead of the projection.

When the recess 156 is provided in the upper blade 151, a portion of the stopping pawl body 142 is fitted into the recess 156 of the upper blade 151 at the time of assembling the slider 140, for example, whereby the stopping pawl body 142 can be positioned with respect to the slider 140. In the assembled slider 140, the stopping pawl body 142 can be held to prevent the position of the stopping pawl body 142 from being deviated. When the pawl portion 143 of the stopping pawl body 142 is made to advance or retreat with respect to the element guide passage, the stopping pawl body 142 can be rotated with the front end of the stopping pawl body 142 fitted into the recess 156 of the upper blade 151 as a fulcrum.

However, in the slider body 150 thus press molded, the dimensional accuracy and the shape accuracy are lower than those of a slider body formed by die cast molding, for example, and when a plurality of the slider bodies 150 are press molded, the shape and dimension of the recess 156 formed in the upper blade 151 by punch pressing may be varied between each of the slider bodies 150.

As described above, when the shape and dimension of the recess 156 of the upper blade 151 are varied, the stopping pawl body 142 cannot be sufficiently fitted into the recess 156 of the upper blade 151 at the time of assembling the slider 140, and the position and posture of the stopping pawl body 142 with respect to the slider body 150 may become unstable, and this causes occurrence of a defect and failure of the stopping mechanism.

Even when the stopping pawl body 142 is fitted into the recess 156 of the upper blade 151, in the case where the shape and dimension of the recess 156 of the upper blade 151 are varied, the movement (swing) of the stopping pawl body 142 may be inhibited.

For example, in a case where the shape of the recess 156 formed in the upper blade 151 is distorted, when the pawl portion 143 of the stopping pawl body 142 is retreated from the element guide passage by operating the tab 146 of the slider 140, in the stopping pawl body 142 a portion fitted into the recess 156 of the upper blade 151 to become a fulcrum is easily caught by the recess 156 concerned. In this case, such a state that the stopping pawl body 142 is caught is held by receiving a biasing force from the resilient member 149, so that the movement of the stopping pawl body 142 may be fixed (the stopping pawl body 142 does not move).

As described above, when the movement of the stopping pawl body 142 is interfered by the recess 156 of the upper blade 151, even if the stopping pawl body 142 receives the pressing force from the resilient member 149 when the operation of the tab 146 is terminated, the pawl portion 143 of the stopping pawl body 142 cannot be made to advance (project) into the element guide passage, so that the stopping mechanism of the slider 140 may not be operated.

Since an end of the stopping pawl body 142 on the side accommodated in the recess 156 is relatively angular, when the corner is a rotating support part, this corner is caught in the recess, whereby the movement of the stopping pawl body 142 may be interfered. This is one of causes that the stopping mechanism of the slider 140 is not operated.

Even in the slider 100 described in the Patent Document 1, for example, the projecting piece 122 of the stopping pawl body 120 is fitted into the recess 119 of the upper blade 111. Thus, when the shape and dimension of the recess 119 formed in the upper blade 111 are varied, as in the slider 140 of the Patent Document 2, when the pawl portion 123 of the stopping pawl body 120 is retreated from the element guide passage by operating the tab 106, the projecting piece 122 as a rotating support part of the stopping pawl body 120 is caught between the recess 119 of the upper blade 111 and the cover body 130 and the stopping pawl body 120 does not move, and the stopping mechanism of the slider 100 may not be operated.

Also in the projecting piece 122 of the stopping pawl body 120 shown in the Patent Document 1, since a portion as a rotating support part is relatively angular, when the corner is in contact with a portion of the recess 119 when the stopping pawl body rotates, the movement of the stopping pawl body 120 may be interfered.

In view of the above problems, a specific object of the invention is to provide a slider in which, in order to prevent an influence of working accuracy in press molding, a stopping pawl body is held at a predetermined position with respect to a slider body and rotated without using a recess formed in the slider body, whereby the stopping mechanism can be stably operated, and, in addition, assembly operation of the slider can be smoothly performed.

Means for Solving the Problems

In order to achieve the above object, a slider provided with a stopping mechanism provided by the invention has, as a basic constitution, a slider body molded by press working, a tab having an attaching shaft portion, a stopping pawl body, a resilient piece provided integrally with or separately from the stopping pawl body and resiliently pressing the stopping pawl body, and a cover body storing the stopping pawl body and the resilient piece and attached to the slider body, and the stopping pawl body has a main body disposed across the attaching shaft portion of the tab and a pawl portion extending from one end side of the main body and capable of engaging a fastener element on an element guide passage of the slider body. In the slider provided with a stopping mechanism, as the most important feature, the stopping pawl body has an extending portion, which extends from the other end side of the main body, extends in a direction approaching an upper blade, and is curved or bent in a direction of a shoulder opening of the slider body, and a projecting portion which projects from a tip portion of the extending portion and is held by the cover body, the extending portion has a rotating support part which is contact with an upper surface of the upper blade of the slider body and becomes a fulcrum when the stopping pawl body rotates, a contact surface with which the rotating support part of the upper blade is in contact is formed into at least a flat surface, and the cover body has a pawl body holding portion holding the projecting portion of the stopping pawl body.

In the slider provided with a stopping mechanism according to the invention, the flat surface is preferably a main surface of the upper blade. Further, the projecting portion of the stopping pawl body is preferably stored and held in the pawl body holding portion of the cover body.

Furthermore, it is preferable that a recess is provided on the upper surface side of the upper blade, and the stopping pawl body has an insertion piece provided perpendicularly from the other end side of the main body and inserted into the recess of the upper blade. In this case, it is particularly preferable that a pair of the extending portions and a pair of the projecting portions are provided, and the insertion piece is provided between a pair of the extending portions and between a pair of the projecting portions.

Furthermore, it is preferable that the tip portion of the extending portion is spaced apart from the upper blade when the tab is not operated.

In the slider provided with a stopping mechanism of the invention, it is preferable that the projecting portion of the stopping pawl body projects from the tip portion of the extending portion in a slider width direction, and the pawl body holding portion is formed at left and right side wall portions of a cover main body in the cover body.

Effects of the Invention

As a result of studies on and improvement of a constitution in which in order to stably operate a stopping mechanism in a slider provided with the stopping mechanism having the press molded slider body, a stopping pawl body is held at a predetermined position with respect to the slider body and, at the same time, can be rotated without using a recess of an upper blade easily affected by working accuracy in press molding, the present inventors have found that a held portion of the stopping pawl body and a rotating support part may be formed separately and have completed the invention.

Namely, a slider provided with a stopping mechanism according to the invention has a slider body, a tab having an attaching shaft portion, a stopping pawl body, a resilient piece provided integrally with or separately from the stopping pawl body, and a cover body. The slider body is press molded, and a flat surface hardly affected by working accuracy according to press molding is formed on an upper surface side of an upper blade.

The stopping pawl body has a main body, a pawl portion extending from one end side of the main body, an extending portion extending from the other end side of the main body, and a projecting portion projecting from a tip portion of the extending portion, and the extending portion is provided with a curved portion or a bent portion curved or bent in a direction of a shoulder opening of the slider body from a direction extending to approach the upper blade and, at the same time, provided with a rotating support part in contact with the flat surface of the upper blade in the slider body. The projecting portion is stored and held in a pawl body holding portion of the cover body.

As described above, the extending portion provided with the rotating support part and the projecting portion are separately provided in the stopping pawl body of the invention, and the projecting portion of the stopping pawl body is held in the pawl body holding portion of the cover body, whereby even if a recess formed in the upper blade as with a conventional press molded slider body, for example, is not used, the stopping pawl body is positioned at a predetermined position with respect to the slider body and can be held stably.

In the slider of the invention, the rotating support part of the stopping pawl body is placed on the flat surface of the upper blade; therefore, when the pawl portion of the stopping pawl body is lifted against a biasing force of the resilient piece in response to operation of the tab and retreated from the element guide passage, or when the pawl portion is advanced (returned) into the element guide passage by receiving the biasing force of the resilient piece when the operation of the tab is terminated, the stopping pawl body can be smoothly rotated (swung) without using the recess formed in the upper blade. In the invention, since the movement of the stopping pawl body is thus hardly affected by the working accuracy according to press molding, it is possible to prevent occurrence of such a problem that the stopping pawl body is caught by the recess of the upper blade, so that the stopping pawl body does not move as in a conventional slider.

In the stopping pawl body of the invention, a rotating support part is provided between the main body pressed by the resilient piece and the projecting portion, and the projecting portion itself is configured to hardly directly receive the biasing force of the resilient piece. Thus, even if the projecting portion of the stopping pawl body is caught by the upper blade or the pawl body holding portion of the cover body, such a state that the stopping pawl body is caught is held (fixed) by receiving the biasing force of the resilient piece hardly occurs.

The projecting portion of the stopping pawl body and the rotating support part are provided separately; therefore, even if the projecting portion is caught by the upper blade and the pawl body holding portion of the cover body when the pawl portion of the stopping pawl body is lifted, the main body of the stopping pawl body is rotated with the rotating support part as a fulcrum by biasing the stopping pawl body with the resilient piece, whereby the pawl portion can be advanced into the element guide passage.

Namely, in the slider of the invention, the stopping pawl body is held at a predetermined position without using the recess portion of the upper blade easily affected by the working accuracy according to press molding, and, at the same time, smooth movement of the stopping pawl body can be secured; therefore, factors causing a defect and failure of the stopping mechanism are reduced, and the stopping mechanism using the stopping pawl body can be stably functioned for a long period of time.

In the slider provided with a stopping mechanism of the invention, the flat surface is configured as a main surface of the upper blade. Here, the main surface of the upper blade means a flat portion having a largest area in a surface of the upper blade. When the rotating support part of the stopping pawl body is thus placed on the flat surface as the main surface of the upper blade, the stopping pawl body can be more smoothly rotated.

In the slider of the invention, the projecting portion of the stopping pawl body is stored and held in the pawl body holding portion of the cover body by an upper surface of the upper blade and the cover body, and it is particularly preferable that the projecting portion is loosely fitted into the pawl body holding portion. According to this constitution, when the stopping pawl body rotates, it is possible to reduce or avoid a possibility that the projecting portion of the stopping pawl body is caught by the pawl body holding portion of the cover body.

In the slider of the invention, the recess portion is provided on the upper surface side of the upper blade, and the stopping pawl body has an insertion piece provided perpendicularly from the other end side of the main body and inserted into the recess of the upper blade. In this case, when the stopping pawl body is placed on the slider body in a process of assembling the slider, the insertion piece of the stopping pawl body is inserted into the recess portion of the upper blade, whereby since the stopping pawl body can be easily positioned with respect to the slider body, the slider can be smoothly assembled.

In the above case, a pair of the extending portions and a pair of the projecting portions are provided, and the insertion piece is provided between a pair of the extending portions and between a pair of the projecting portions. In the case where the stopping pawl body is thus configured, when the stopping pawl body is formed from a flat metal plate, for example, the insertion piece capable of being inserted into the recess portion of the upper blade can be easily provided.

In the slider of the invention, as described above, when the projecting portion of the stopping pawl body is held by the cover body, the stopping pawl body is mounted at a predetermined position; therefore, in the insertion piece of the stopping pawl body, the stopping pawl body may be positioned only until the cover body is mounted on the slider body. When the insertion piece of the stopping pawl body is caught by the recess portion of the upper blade when the stopping pawl body swings, smooth swing of the stopping pawl body may be inhibited. Thus, it is preferable that the insertion piece of the stopping pawl body is loosely fitted into the recess portion of the upper blade (in other words, is loosely inserted in a floating state).

In the slider of the invention, since the tip portion of the extending portion in the stopping pawl body is provided to be spaced apart from the upper blade when the tab is not operated, when the stopping pawl body is rotated to retreat the pawl portion from the element guide passage, a space where the tip portion of the extending portion can move down can be secured. When the pawl portion retreats from the element guide passage, a possibility that the tip portion of the extending portion is strongly pressed against the upper blade and caught by the upper blade can be reduced or avoided. Thus, the movement of the stopping pawl body can be more stably secured.

In the slider of the invention, the projecting portion of the stopping pawl body projects from the tip portion of the extending portion in a slider width direction, and the pawl body holding portion is provided at left and right side wall portions of the cover main body in the cover body. When the projecting portion is held in the pawl body holding portion of the cover body, the stopping pawl body can be stably held at a predetermined position, particularly a predetermined position in a slider length direction.

MODES FOR CARRYING OUT THE INVENTION

Hereinafter, preferred embodiments of the invention will be described in detail with reference to drawings, using embodiments. The invention is not limited at all to the embodiments described below, and a variety of modifications can be made as long as substantially the same constitution as the invention is obtained and similar operation and effect are provided. For example, in the invention, materials of components constituting a slider are not limited particularly and can be changed arbitrarily.

First Embodiment

Figure 1:
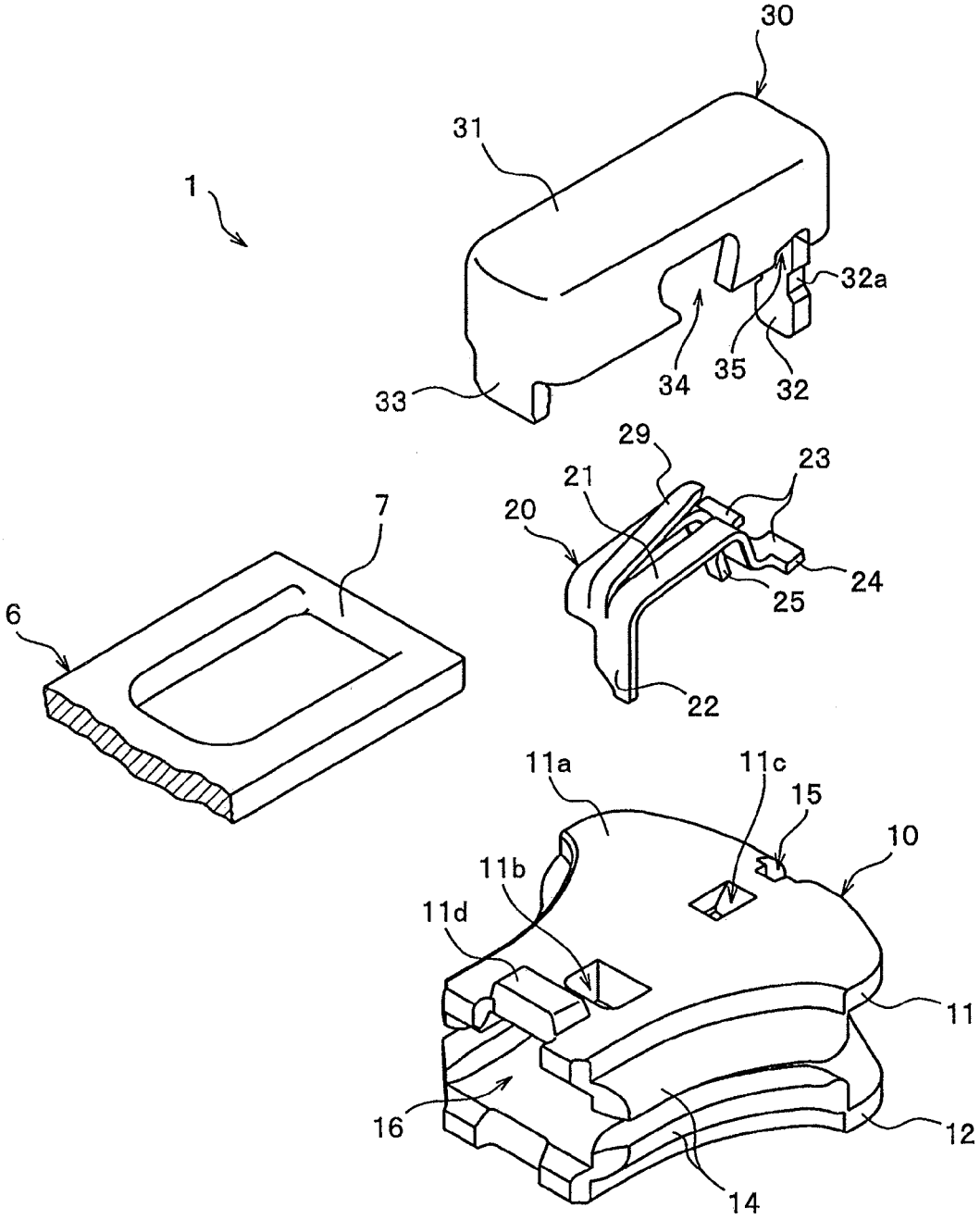
FIG. 1 is a perspective view showing a state in which a slider provided with a stopping mechanism according to a first embodiment of the invention is exploded.
Figure 2:
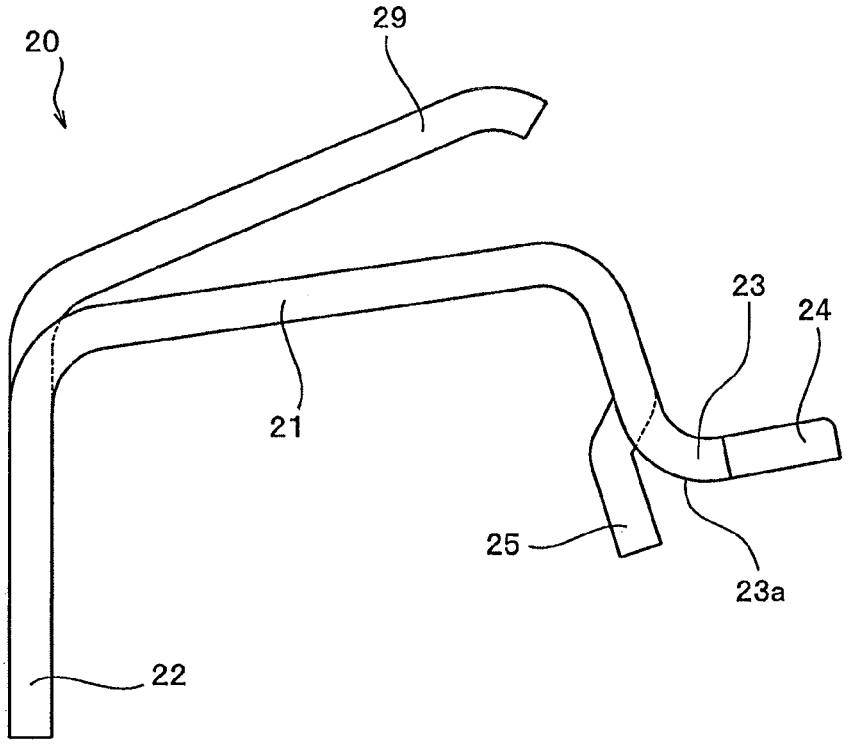
FIG. 2 is a side view showing a stopping pawl body provided in the slider.
Figure 3:
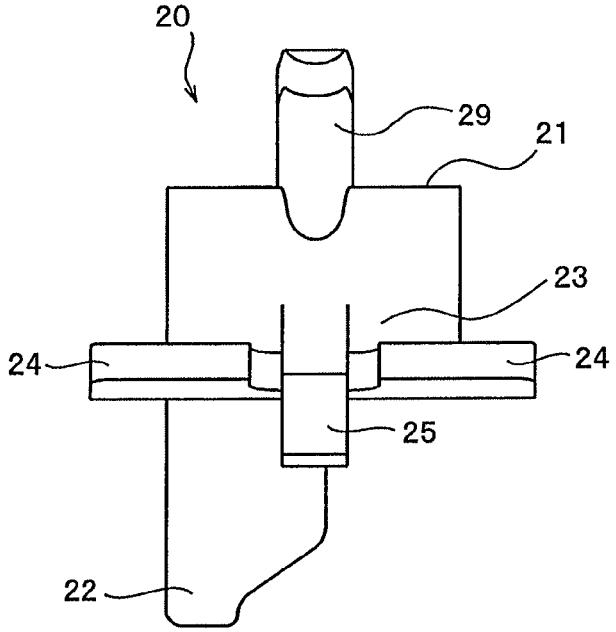
FIG. 3 is a front view of the stopping pawl body.
Figure 4:
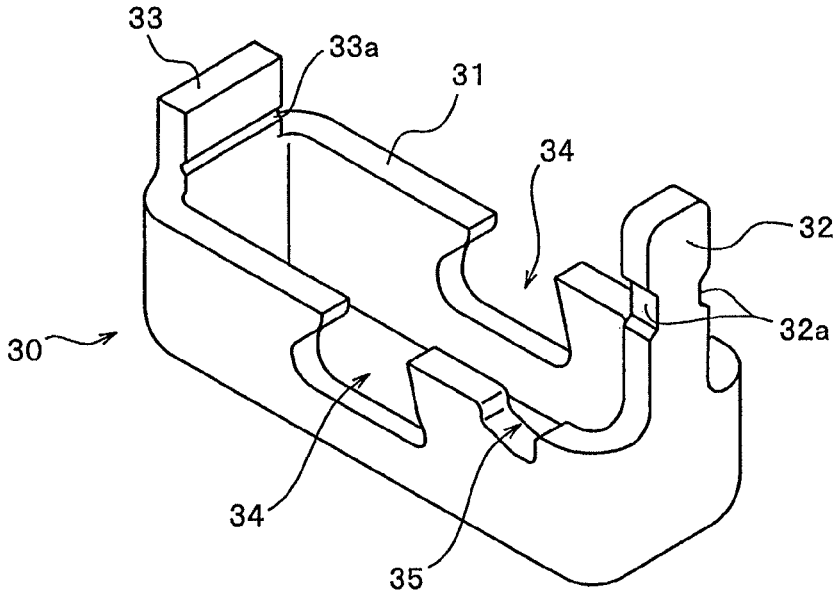
FIG. 4 is a perspective view showing a cover body provided in the slider.
Figure 5:
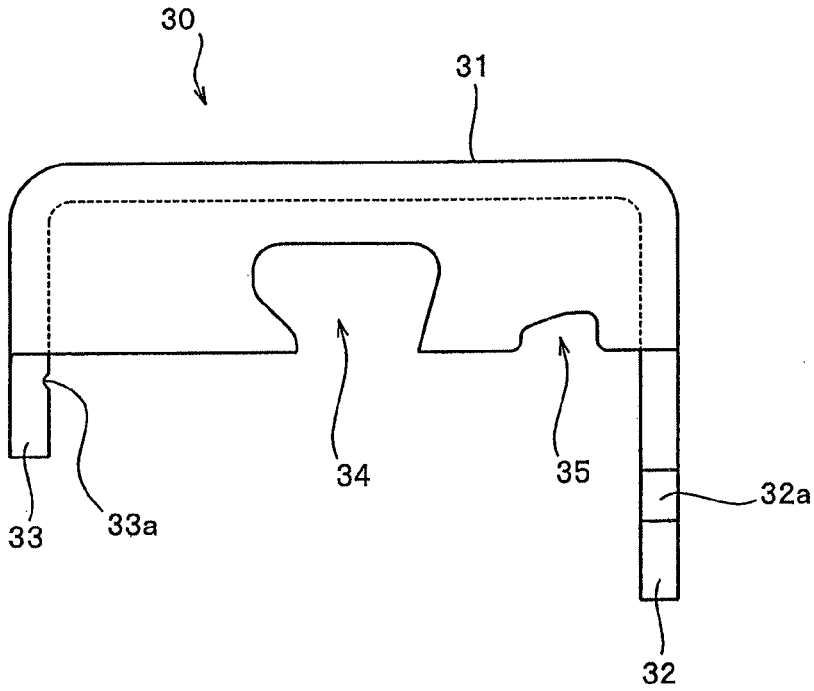
FIG. 5 is a side view of the cover body.
Figure 6:
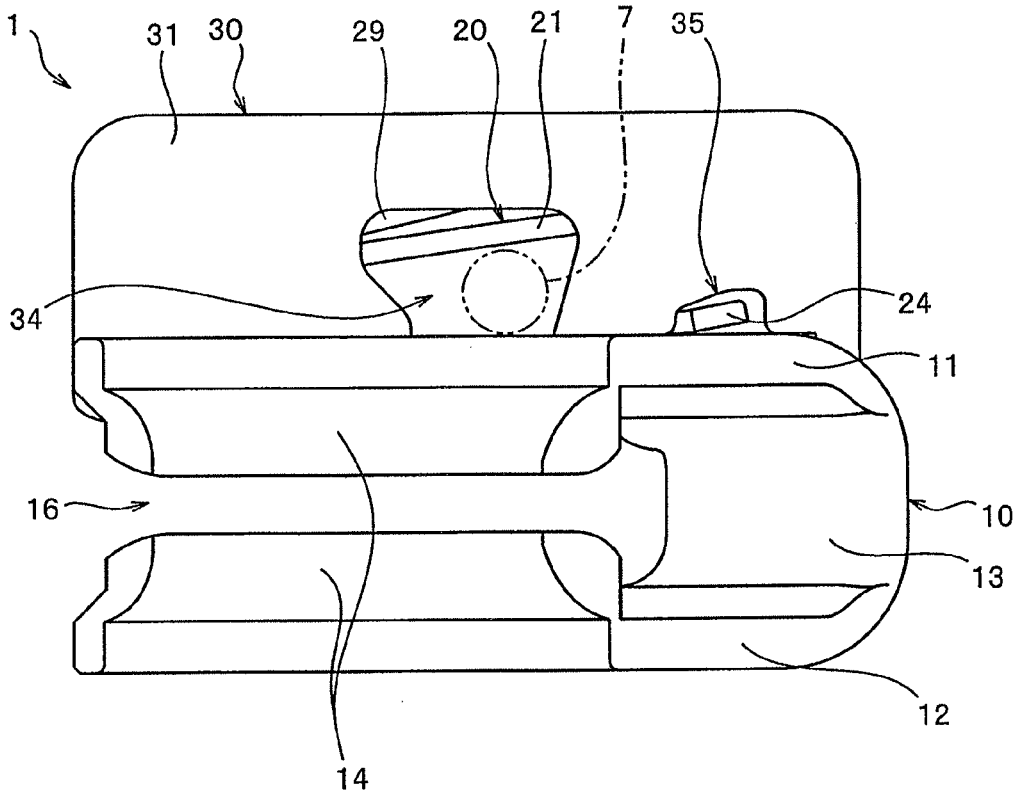
FIG. 6 is a side view of the slider.

FIG. 1 is a perspective view showing a state in which a slider provided with a stopping mechanism according to a first embodiment of the invention is exploded. FIGS. 2 and 3 are respectively side view and front views showing a stopping pawl body provided in the slider, and FIGS. 4 and 5 are respectively perspective view and side view showing a cover body provided in the slider. FIG. 6 is a side view of the slider being in an assembled state.

In the following description, a longitudinal direction of the slider means a direction (length direction of the slider) parallel to a sliding direction of the slider, a direction in which the slider is slid to mesh left and right element rows with each other is forward (shoulder opening side direction), and a direction in which the slider is slid to separate the left and right element rows from each other is rearward (rear opening side direction).

A vertical direction of the slider means a height direction of the slider, a direction on the side on which a tab is attached to a slider body is upward, and a direction opposite to this is downward. A horizontal direction of the slider is a direction perpendicular to the sliding direction of the slider and means a width direction of the slider.

Figure 8:
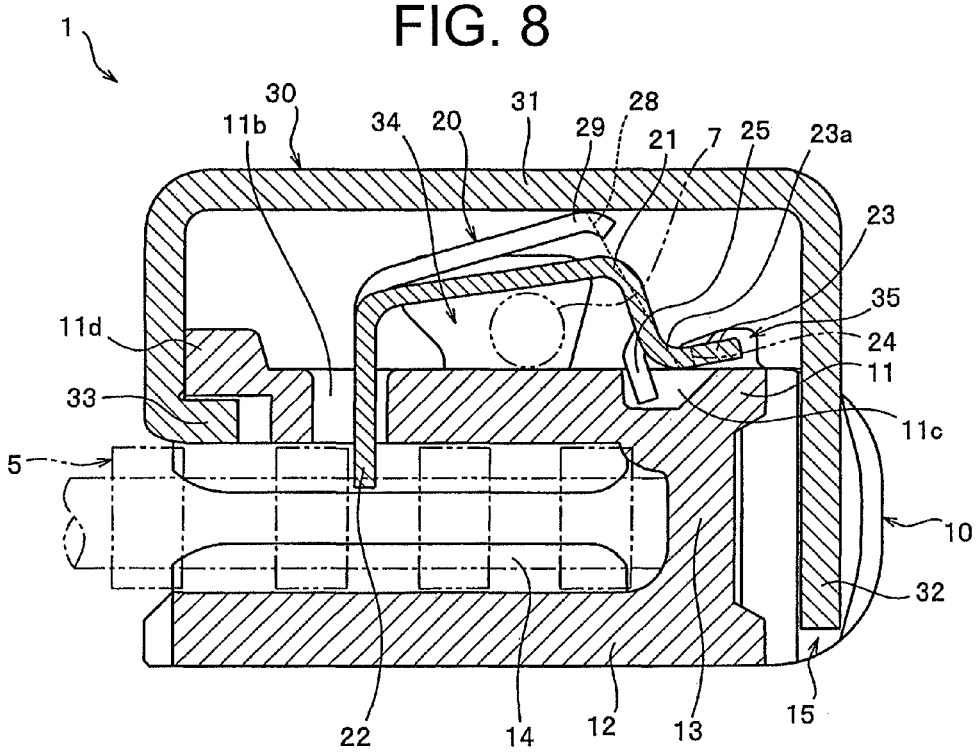
FIG. 8 is a cross-sectional view showing a state in which a stopping mechanism of the slider operates.

A slider 1 according to the first embodiment is one of components of a slide fastener and is configured as a slider 1 provided with a stopping mechanism in which a stopped state of the slider 1 can be held when the slider 1 is stopped with respect to an element row 5 (see, FIG. 8). The slider 1 has a slider body 10, a tab 6 having an attaching shaft portion 7 at one end, a stopping pawl body 20 provided integrally with a resilient piece 29, and a cover body 30 mounted on the slider body 10.

In the above case, the slider body 10, the tab 6, and the cover body 30 are formed into a predetermined shape by press-working a metal plate such as a copper alloy plate, and the stopping pawl body 20 is formed into a predetermined shape by press-working a metal plate such as a stainless plate. In the invention, although only the press-molded slider body 10 is used, a method of forming the tab 6, the stopping pawl body 20, and the cover body 30 are not limited particularly.

The slider body 10 has an upper blade 11, a lower blade 12 provided to be spaced apart from the upper blade 11, a diamond 13 connecting front ends of the upper and lower blades 11 and 12 (shoulder opening side ends), and flange portions 14 arranged at left and right side edges of the upper and lower blades 11 and 12. In the front end of the slider body 10, an engagement recess portion 15 used for engaging a forward attaching piece 32 of the cover body 30 to be described later is provided from an upper surface side of the upper blade 11 to a lower surface side of the lower blade 12 through a front surface side of the diamond 13.

Further, in the front end of the slider body 10, left and right shoulder openings are formed while holding the diamond 13 in between, and a rear opening is formed in a rear end of the slider body 10. Further, a Y-shaped element guide passage 16 communicating the left and right shoulder opening with the rear opening is formed between the upper and lower blades 11 and 12.

A flat surface 11*a* as a main surface is provided on the upper surface side of the upper blade 11 and is a surface formed without being directly subjected to press-working applied to a metal plate. The upper blade 11 has a pawl hole 11*b* into which a pawl portion 22, which will be described later, of the stopping pawl body 20 is inserted and a recess portion 11*c* which is provided more forward than the pawl hole 11*b* and in which an insertion piece 25, which will be described later, of the stopping pawl body 20 is inserted. In a rear end of the upper blade 11, a rearward engaging portion 11*d* engaged by caulking a rearward attaching piece 33, which will be described later, of the cover body 30 is provided.

As shown in FIGS. 2 and 3, the stopping pawl body 20 of the first embodiment has a main body 21 having a shape bent to open downward, a pawl portion 22 provided perpendicularly from a rear end of the main body 21 and inserted into a pawl hole 11*b* of the upper blade 11, a pair of left and right extending portions 23 extending from a front end of the main body 21 and curved forward, a pair of projecting portions 24 projecting from a tip portion of each of the extending portions 23 toward outside in the horizontal direction, an insertion piece 25 provided perpendicularly from the front end of the main body 21 to be held between the left and right extending portions 23, and a resilient pieces 29 extending on the upper surface side of the main body 21.

The main body 21 of the stopping pawl body 20 has an intermediate portion extending along a slider length direction, a front end portion extending while curving from a front end of the intermediate portion, and a rear end portion extending while curving from a rear end of the intermediate portion, and the main body 21 includes a space storing the attaching shaft portion 7 of the tab 6.

The width dimension of the pawl portion 22 is smaller than that of a rear end of the main body 21, and the pawl portion 22 extends downward parallel to the rear end of the main body 21. The pawl portion 22 has at its tip portion a gradually decreasing portion which gradually decreases the width dimension of the pawl portion 22 toward the tip portion.

The left and right extending portions 23 extends downward approaching the upper blade 11 from the front end of the main body 21 while holding the insertion piece 25 in between and further extends forward (shoulder opening direction side of the slider body 10) through a curved portion 23*a*. When the slider 1 is configured so that the stopping pawl body 20 is attached to the slider body 10, the extending portion 23 (particularly, the curved portion 23*a*) is in contact with a smooth flat surface 11*a* of the upper blade 11, and an outer peripheral surface (curved surface) of a curved portion 23*a* in the extending portion 23 is a contact surface in contact with the flat surface 11*a* of the upper blade 11.

The extending portion 23 (particularly, a curved surface of the extending portion 23) functions as a rotating support part, which is in contact with the flat surface 11*a* of the upper blade 11 and supports rotation (swing) of the stopping pawl body 20 when the stopping pawl body 20 is lifted to retreat the pawl portion 22 from the element guide passage 16, as described later, and when the pawl portion 22 is made to advance into the element guide passage 16.

The tip portion of the extending portion 23 is formed to be inclined upward from the curved portion 23*a* of the extending portion 23 to a tip edge so as to be floated by being spaced apart upward from an upper surface (flat surface 11*a*) of the upper blade 11 (see, FIG. 8) when the stopping mechanism operates in the slider 1 (in other words, when the tab 6 is not operated).

According to this constitution, when the tab 6 of the slider 1 is not operated, a gap portion is provided between the tip portion of the extending portion 23 and the upper blade 11; therefore, the gap portion can be used as a movable region of the extending portion 23 when the stopping pawl body 20 rotates to lift the pawl portion 22. Accordingly, when the rotation of the stopping pawl body 20 is smoothed, and, at the same time, when the pawl portion 22 is lifted, a possibility that the tip portion of the extending portion 23 is strongly pressed against the upper blade 11 and caught by the upper blade 11 can be reduced.

The tip portion of the extending portion 23 is provided with a pair of left and right projecting portions 24 projecting outward from the extending portion 23 along a slider width direction, and the left and right projecting portions 24 are provided corresponding to the position of a pawl body holding portion 35, which will be described later, of the cover body 30.

The insertion piece 25 of the stopping pawl body 20 extends downward from the front end of the main body 21 so as to be located between the pair of left and right extending portions 23 and between the pair of left and right projecting portions 24. The insertion piece 25 has a downward inclined portion obliquely inclined downward from the front end of the main body 21 toward the rear side and a perpendicular portion perpendicularly provided from the downward inclined portion through a bending portion and is configured that when the slider 1 is assembled, a tip portion of the insertion piece 25 (that is, a tip portion of the perpendicular portion) is inserted into the recess portion 11*c* of the upper blade 11.

In particular, in the slider 1 of the first embodiment, in the tip portion of the insertion piece 25, in order to prevent the stopping pawl body 20 from being caught by the recess portion 11*c* of the upper blade 11 when the stopping pawl body 20 swings, it is preferable that even if the tip portion of the insertion piece 25 is inserted into the recess portion 11*c*, the tip portion of the insertion piece 25 is held in a state of floating in the recess portion 11*c* of the upper blade 11 without being in contact with an inner peripheral surface and a bottom surface of the recess portion 11*c* when the tab 6 is operated or not operated. In other words, it is preferable that the insertion piece 25 is prevented from becoming a fulcrum of the stopping pawl body 20 when the tab is operated.

The resilient piece 29 is formed integrally with the stopping pawl body 20, extends to be branched upward from a portion curved from the rear end of the main body 21 to the intermediate portion, and is provided to be inclined upward from an end on a connection side connected to the main body 21 toward the tip portion. When the resilient piece 29 is thus configured integrally with the stopping pawl body 20, the number of components of the slider can be reduced; therefore, the assembling operation of the slider is simplified, and, at the same time, the cost of the slider can be reduced.

In the resilient piece 29, the tip portion of the resilient piece 29 is deflected while being in sliding contact with an inner wall upper surface of the cover body 30, whereby the stopping pawl body 20 (in particular, the main body 21 of the stopping pawl body 20) is resiliently pressed to advance the pawl portion 22 into the element guide passage 16 through the pawl hole 11*b* of the slider body 10. In this case, since the tip portion of the resilient piece 29 is made hardly catchable by the inner wall upper surface of the cover body 30 even if the stopping pawl body 20 is swung, a tip portion upper surface of the resilient piece 29 in sliding contact with the inner wall upper surface of the cover body 30 is formed into a curved surface.

In the above case, the stopping pawl body 20 of the first embodiment is configured that the projecting portion 24 is provided at a position more forward than the rotating support part in the extending portion 23 and is hardly directly receive a pressing force (biasing force) of the resilient piece 29. Thus, for example, a possibility that the projecting portion 24 is caught by the flat surface 11*a* of the upper blade 11 and the pawl body holding portion 35, which will be described later, of the cover body 30 is reduced, and even if the projecting portion 24 is caught, the caught state is hardly maintained.

As shown in FIG. 8, the stopping pawl body 20 of the first embodiment is configured that the position of the rotating support part of the extending portion 23 (contact portion in contact with the flat surface 11*a* of the upper blade 11) and the position of the contact portion where the tip portion of the resilient piece 29 is in contact with the inner wall upper surface of the cover body 30 are relatively deviated in the slider length direction, and a line 28 connecting them is obliquely inclined with respect to the slider height direction.

According to such a configuration of the stopping pawl body 20, for example, in comparison with a case where the position of the rotating support part of the extending portion 23 and the contact portion where the tip portion of the resilient piece 29 is in contact with the cover body 30 approach the slider length direction (when the line 28 connecting them approaches more parallel to the slider height direction), when the stopping pawl body 20 is lifted so that the pawl portion 22 is retreated from the element guide passage 16, as described later, the stopping pawl body 20 is made to be hardly held and caught between the upper blade 11 and the inner wall supper surface of the cover body 30.

As shown in FIGS. 4 and 5, the cover body 30 of the first embodiment has a box-shaped cover main body 31 whose lower side (bottom surface side) is opened and forward attaching piece 32 and rearward attaching piece 33 provided perpendicularly from a front end and a rear end of the cover main body 31 and is configured that the stopping pawl body 20 is stored in the cover main body 31.

In the left and right side wall portions of the cover main body 31, a notched tab holding portion 34 for holding the attaching shaft portion 7 of the tab 6 and the notched pawl body holding portion 35 for holding the projecting portion 24 of the stopping pawl body 20 are formed. In this case, the tab holding portion 34 of the cover main body 31 is formed so that the dimension in the slider length direction of the tab holding portion 34 gradually increases upward.

As shown in FIG. 6, the pawl body holding portion 35 of the cover main body 31 is formed so that the dimension in the slider height direction of the pawl body holding portion 35 gradually increases forward, and the projecting portion 24 of the stopping pawl body 20 is stored and held in the pawl body holding portion 35 or, in other words, loosely fitted into the pawl body holding portion 35.

The forward attaching piece 32 of the cover body 30 has a shape corresponding to the engagement recess portion 15 provided in the slider body 10, and constriction portions 32*a* partially reducing the width dimension of the forward attaching piece 32 are provided at the left and right side edge portions of the forward attaching piece 32. A recess groove portion 33*a* formed along the slider width direction is provided at a front surface of the rearward attaching piece 33 of the cover body 30. According to this constitution, when the rearward attaching piece 33 is caulked to the slider body 10 to attach the cover body 30 to the slider body 10, the rearward attaching piece 33 can be stably and easily bent at a predetermined position.

Next, a procedure of assembling the slider 1 of the first embodiment will be described.

Before the assembly process, a pair of the slider bodies 10 formed into a predetermined shape by press-working a metal plate, the tab 6, the stopping pawl body 20, and the cover body 30 are provided.

First, the attaching shaft portion 7 of the tab 6 is placed on the upper blade 11 of the slider body 10. At this time, the attaching shaft portion 7 of the tab 6 is placed on an upper surface (flat surface 11*a*) of the upper blade 11 between the recess portion 11*c* and the pawl hole 11*b* of the upper blade 11 along the slider width direction.

Figure 7:
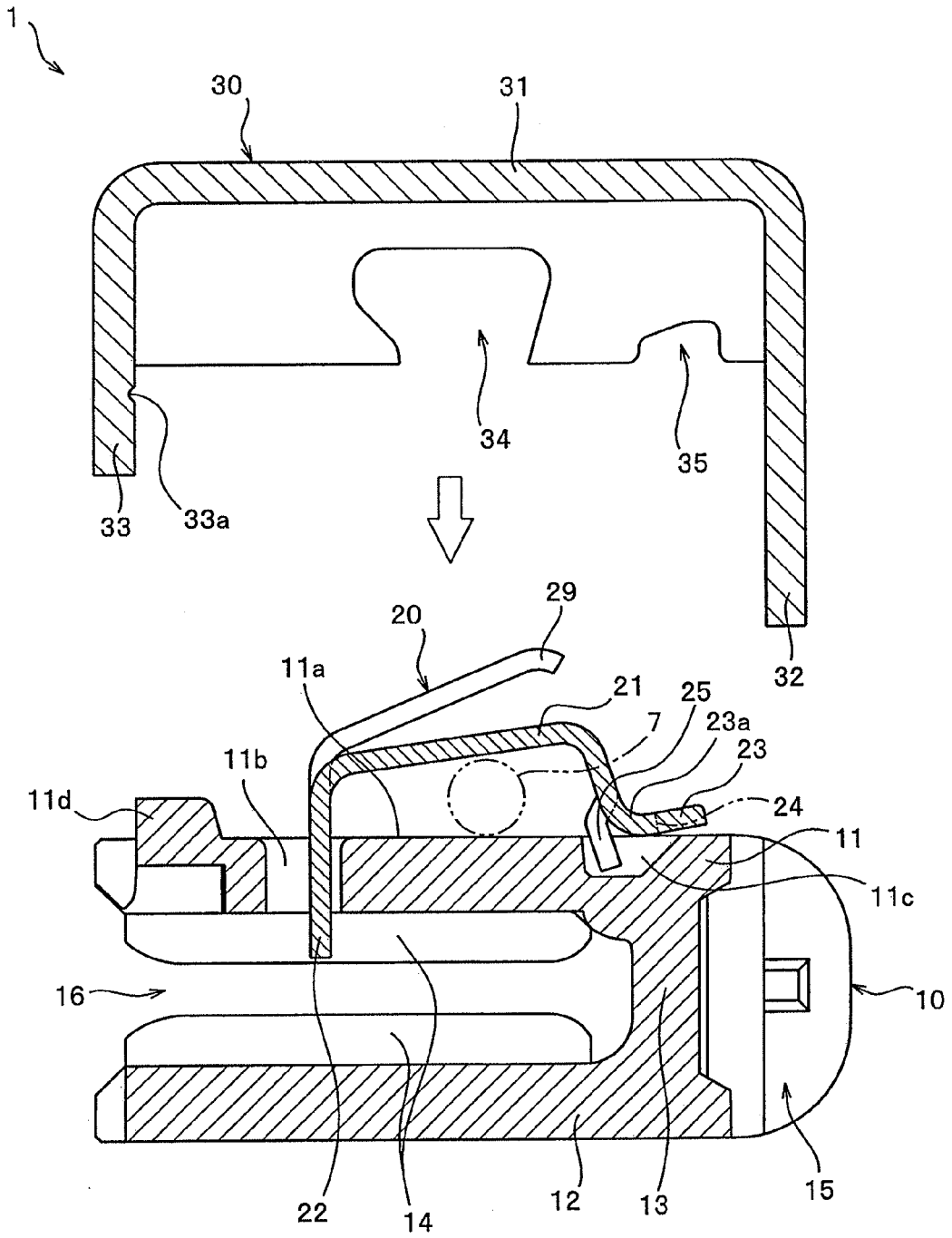
FIG. 7 is a cross-sectional view showing a state before the cover body is mounted on the slider body on which an attaching shaft portion of a tab and the stopping pawl body are placed.

Subsequently, as shown in FIG. 7, the stopping pawl body 20 is placed on the upper blade 11 on which the attaching shaft portion 7 of the tab 6 is placed. In FIG. 7, the attaching shaft portion 7 of the tab 6 is shown by a virtual line to show a positional relationship between the slider body 10 and the stopping pawl body 20 in an easy-to-understand manner.

At that time, the stopping pawl body 20 is placed on the upper blade 11 so that the main body 21 of the stopping pawl body 20 straddles the attaching shaft portion 7 of the tab 6, and, at the same time, the extending portion 23 of the stopping pawl body 20 is brought into contact with the flat surface 11*a* of the upper blade 11. The pawl portion 22 of the stopping pawl body 20 is inserted into the pawl hole 11*b*, and, at the same time, the insertion piece 25 of the stopping pawl body 20 is inserted into the recess portion 11*c* of the upper blade 11, whereby a relative position of the stopping pawl body 20 with respect to the slider body 10 is temporarily determined.

After the attaching shaft portion 7 of the tab 6 and the stopping pawl body 20 are placed on the slider body 10, the slider body 10 is covered with the cover body 30. At this time, the main body 21 of the stopping pawl body 20 is stored in the cover main body 31 of the cover body 30, and, at the same time, the attaching shaft portion 7 of the tab 6 is held in the tab holding portion 34 of the cover body 30. Further, the projecting portion (engaged portion) 24 of the stopping pawl body 20 is held in the pawl body holding portion 35 of the cover body 30.

In the case of the first embodiment, as described above, the insertion piece 25 of the stopping pawl body 20 is inserted into the recess portion 11*c* of the upper blade 11, whereby the stopping pawl body 20 is positioned; therefore, when the cover body 30 is laid over the slider body 10 while being aligned with respect to the slide body 10, the main body 21 of the stopping pawl body 20 is stored in the cover main body 31, and, at the same time, the projecting portion 24 of the stopping pawl body 20 is stably held in the pawl body holding portion 35 of the cover body 30. Accordingly, in the slider 1 of the first embodiment, when the slider body 10 is covered with the cover body 30, the position of the stopping pawl body 20 is not required to be regulated each time, and the slider 1 can be assembled simply and smoothly.

After the slider body 10 is covered with the cover body 30, a caulking process in which a tip portion of the rearward attaching piece 33 in the cover body 30 is pressed to be bent forward, and, thus, to be plastically deformed is performed. At this time, as described above, since a recess groove portion 33*a* is formed on the front surface of the rearward attaching piece 33, the rearward attaching piece 33 can be easily bent at a predetermined position.

The rearward attaching piece 33 is thus plastically deformed, and, at the same time, a portion of the front end side of the slider body 10 is bent by being pressed toward the forward attaching piece 32 of the cover body 30, whereby the caulking process of fixing the forward attaching piece 32 of the cover body 30 to the slider body 10 is performed. Consequently, the slider 1 of the first embodiment shown in FIGS. 6 and 8 are assembled.

In the slider of the invention, means for fixing the cover body to the slider body is not limited to the above structure in which the caulking process is performed, and, for example, a structure in which flexibility is given to the cover body, and the cover body is fixed to the slider body in the form of a snap can be employed.

In the slider 1 of the first embodiment assembled as described above, since the projecting portion 24 of the stopping pawl body 20 is held in the pawl body holding portion 35 of the cover body 30 by the flat surface 11*a* of the upper blade 11 having a stable shape and the cover body 30, the stopping pawl body 20 is stably assembled on the slider body 10 at a predetermined position, particularly a predetermined position in the slider length direction. The position in the slider width direction of the stopping pawl body 20 is controlled by the fact that the main body 21 of the stopping pawl body 20 is provided between the left and right inner wall surfaces of the cover main body 31 of the cover body 30 and the fact that the pawl portion 22 of the stopping pawl body 20 is inserted into the pawl hole 11*b* of the upper blade 11.

As shown in FIG. 8, when the slider 1 of the first embodiment is in a state where the tab 6 is not operated, and the stopping pawl body 20 is not lifted by the attaching shaft portion 7 of the tab 6, the stopping pawl body 20 is biased by the resilient piece 29, and the pawl portion 22 is made to advance into the element guide passage 16 through the pawl hole 11*b* of the slider body 10. According to this constitution, when the slider 1 is used in the slide fastener, the stopping mechanism holding the slider 1 at a position where the slider 1 is stopped with respect to the element row 5 of the slide fastener can be operated.

Figure 9:
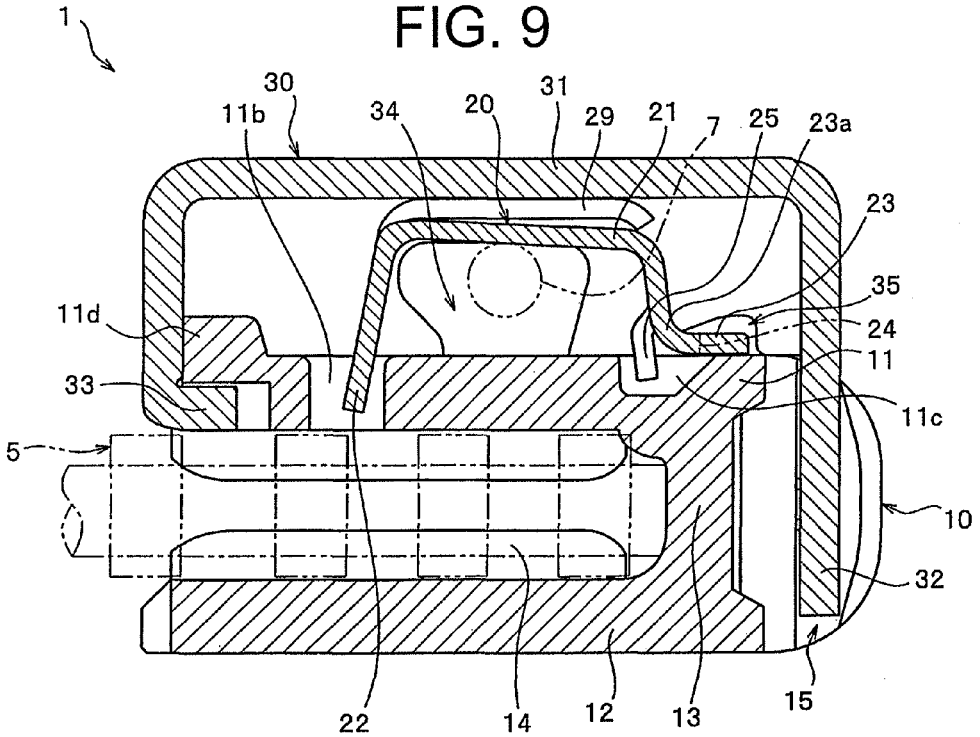
FIG. 9 is a cross-sectional view showing a state in which the stopping mechanism of the slider is released.

Meanwhile, as shown in FIG. 9, when the slider 1 is slid by operating the tab 6, the stopping pawl body 20 is lifted upward against the biasing force of the resilient piece 29 by the attaching shaft portion 7 of the tab 6; therefore, the entire stopping pawl body 20 rotates with the contact surface of the extending portion 23, which is in contact with the flat surface 11*a* of the upper blade 11, as a fulcrum to retreat the pawl portion 22 from the element guide passage 16. According to this constitution, the stopping mechanism of the slider 1 is released, and the slider 1 can be freely slid along the element row 5 of the slide fastener.

At that time, in the slider 1 of the first embodiment, as described above, since the stopping pawl body 20 is configured that the line 28 connecting the rotating support part of the extending portion 23 and the contact portion where the tip portion of the resilient piece 29 is in contact with the inner wall upper surface of the cover body 30 is obliquely inclined with respect to the slider height direction, even if the stopping pawl body 20 is lifted, the possibility that the stopping pawl body 20 is held and caught between the upper blade 11 and the inner wall upper surface of the cover body 30 can be reduced.

As shown in FIGS. 8 and 9, the position as the rotating support part of the extending portion 23 moves from rearward to forward before and after the operation of the tab. Since there is provided the configuration in which the rotating support part can be moved in accordance with the movement of the stopping pawl, the inclination angle of the line 28 connecting the rotating support part of the extending portion 23 and the contact portion where the tip portion of the resilient piece 29 is in contact with the inner wall upper surface of the cover body 30 is not much changed before and after the operation, so that even if the stopping pawl body 20 is lifted, the possibility that the stopping pawl body 20 is held and caught between the upper blade 11 and the inner wall upper surface of the cover body 30 can be reduced.

After that, when the sliding operation of the slider 1 is terminated, the force with which the attaching shaft portion 7 of the tab 6 lifts the stopping pawl body 20 does not act; therefore, as shown in FIG. 8, the stopping pawl body 20 is biased by the resilient piece 29, and the entire stopping pawl body 20 rotates with the contact surface of the extending portion 23, which is in contact with the flat surface 11*a* of the upper blade 11, as a fulcrum to advance the pawl portion 22 into the element guide passage 16. Consequently, the stopping mechanism can be operated again.

In the first embodiment, even if the projecting portion 24 of the stopping pawl body 20 is caught by the upper blade 11 or the pawl body holding portion 35 of the cover body 30 when the stopping pawl body 20 is lifted, since the projecting portion 24 and the rotating support part of the extending portion 23 are provided separately, the stopping pawl body 20 can be rotated by being biased by the resilient piece 29 so that the pawl portion 22 advances into the element guide passage 16.

Namely, in the slider 1 of the first embodiment, the stopping pawl body 20 can be smoothly swung in the direction in which the pawl portion 22 retreats from the element guide passage 16 and in the direction in which the pawl portion 22 advances into the element guide passage 16 with the contact surface in contact with the flat surface 11*a* of the upper blade 11 as a fulcrum. The stopping pawl body 20 is thus swung with the contact surface between the flat surface 11*a* of the upper blade 11 hardly affected by the working accuracy according to press molding and the stopping pawl body 20 as a fulcrum, whereby the stopping pawl body 20 can be smoothly swung without being caught by the upper blade 11; therefore, a defect and failure of the stopping mechanism hardly occur, so that the stopping mechanism can be stably operated for a long period of time.

In the invention, a slider is not limited to the form of the slider 1 described in the first embodiment and can be arbitrarily designed and changed according to need. For example, in order to enhance an external appearance quality (visual quality) of a slider, when the stopping pawl body is desired to be hidden so as to be hardly seen from outside as much as possible, a slider according to a modification can be configured by using, for example, a cover body 40 shown in FIG. 10 and a stopping pawl body (not shown) in which a dimension in a slider width direction of a projecting portion (projection amount in the slider width direction) is reduced.

Figure 10:
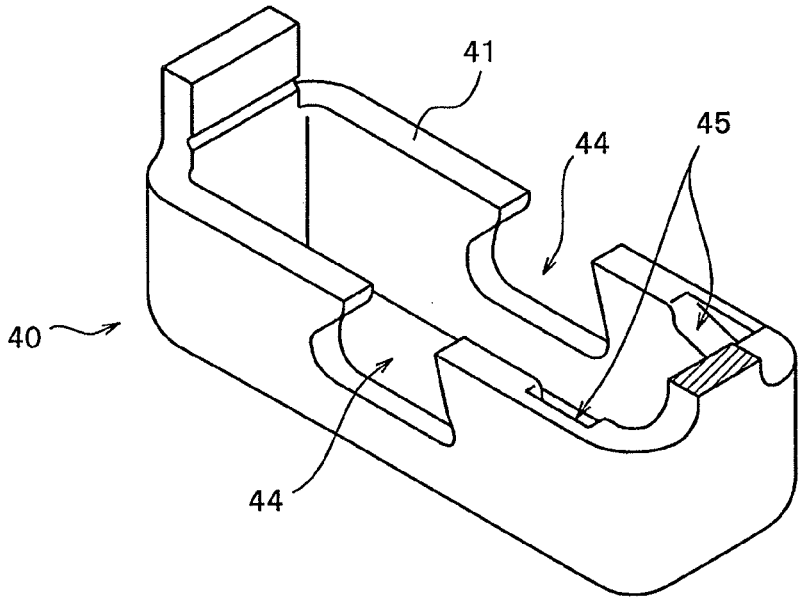
FIG. 10 is a perspective view showing a cover body according to a modification of first embodiment.

Here, in the cover body 40 shown in FIG. 10, although a tab holding portion 44 holding the attaching shaft portion 7 of the tab 6 and a pawl body holding portion 45 holding the projecting portion of the stopping pawl body are provided in left and right side wall portions of a box-shaped cover main body 41, the pawl body holding portion 45 does not have the form of a notched hole portion penetrating through each of the left and right side wall portions of the cover main body 41 in an element width direction and is constituted of a void (recess portion) recessed on the inner wall surface side of each of the left and right side wall portions.

In the slider of the modification having the cover body 40 having the pawl body holding portion 45 and the stopping pawl body in which the projection amount in the horizontal direction of the projecting portion is smaller than that in the first embodiment, since the projecting portion of the stopping pawl body is held in the pawl body holding portion 45 of the cover body 40, the stopping pawl body is stably held at a predetermined position with respect to a slider body.

In the slider of the modification, as in the slider 1 of the first embodiment, since a contact surface between a flat surface of an upper blade and an extending portion of the stopping pawl body can be used as a fulcrum supporting the swing of the stopping pawl body, a defect and failure of the stopping mechanism hardly occur. Since the projecting portion of the stopping pawl body held in the pawl body holding portion 45 of the cover body 40 is not seen from outside by being hidden by the left and right side wall portions of the cover body 40, the external appearance quality of the slider is enhanced.

Second Embodiment

Figure 11:
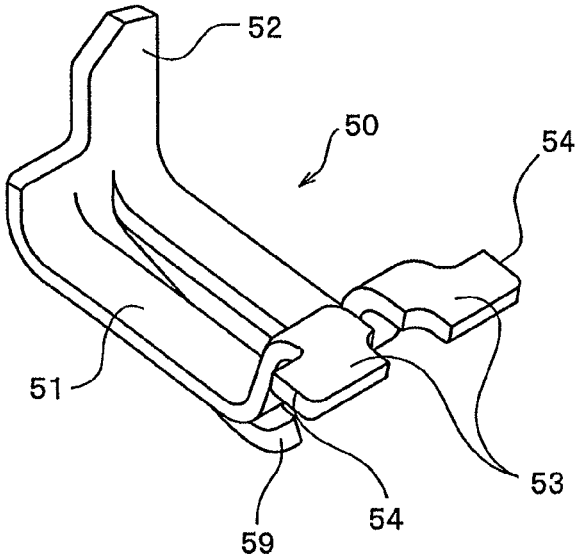
FIG. 11 is a perspective view showing a stopping pawl body of a slider provided with a stopping mechanism according to a second embodiment of the invention.
Figure 12:
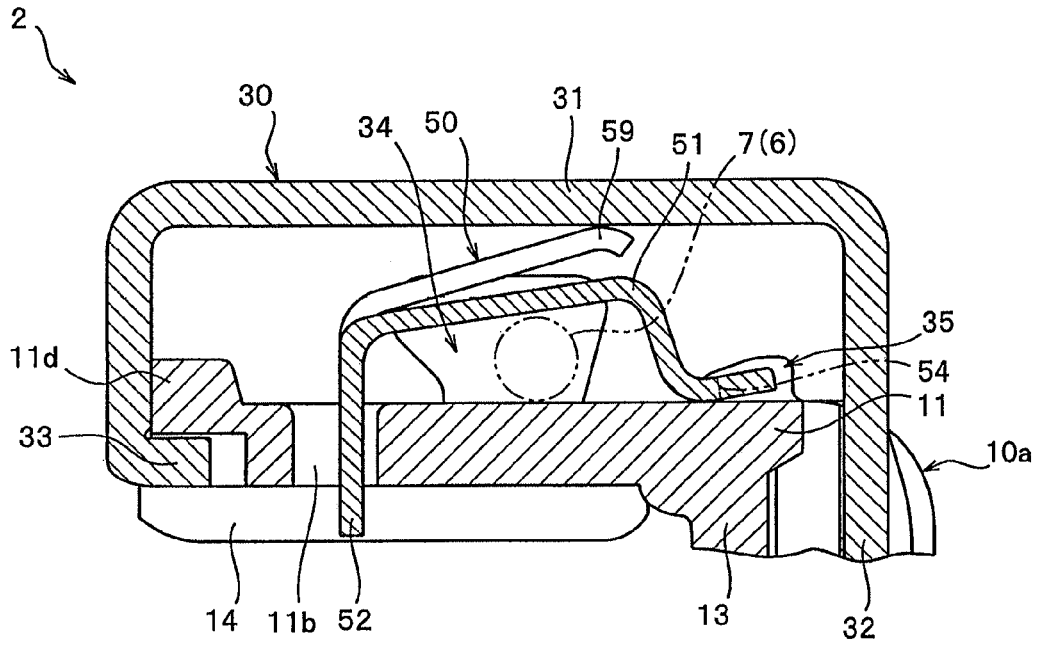
FIG. 12 is a cross-sectional view showing a relevant portion of the slider.

FIG. 11 is a perspective view showing a stopping pawl body provided in a slider according to a second embodiment, and FIG. 12 is a cross-sectional view showing a relevant portion of the slider according to the second embodiment.

In the second embodiment and third and fourth embodiments to be described later, a configuration different from that of the slider according to a first embodiment will be mainly described, components and members having the substantially same configuration as the slider according to the first embodiment are denoted by the same reference numeral, and thus description will be omitted.

A slider 2 according to the second embodiment has a slider body 10*a*, a tab 6 having an attaching shaft portion 7 at one end, a stopping pawl body 50 provided integrally with a resilient piece 59, and a cover body 30 mounted on the slider body 10*a*.

The tab 6 and the cover body 30 in the second embodiment are configured substantially similarly to those of the slider 1 according to the first embodiment, and the slider body 10*a* in the second embodiment is configured similarly to the slider body 10 in the first embodiment except that the upper blade 11 does not have a recess portion.

The stopping pawl body 50 of the second embodiment has a main body 51 having a shape opening downward, a pawl portion 52 provided perpendicularly from a rear end of the main body 51, a pair of left and right extending portions 53 extending from a front end of the main body 51 and curved forward, a pair of projecting portions 54 projecting from a tip portion of each of the extending portions 53 toward outside in the horizontal direction, and a resilient piece 59 extending on the upper surface side of the main body 51. The stopping pawl body 50 is configured similarly to the stopping pawl body 20 of the first embodiment except that the insertion piece 25 provided in the stopping pawl body 20 of the first embodiment is omitted.

When the slider 2 of the second embodiment is assembled, the attaching shaft portion 7 of the tab 6 is placed on the upper blade 11 of the slider body 10*a*, and the stopping pawl body 50 is further placed on the upper blade 11. At this time, the upper blade 11 of the second embodiment does not have the recess portion 11*c* as in the first embodiment, and the insertion piece 25 is not provided in the stopping pawl body 50; however, the pawl portion 52 of the stopping pawl body 50 is inserted into a pawl hole 11*b* of the upper blade 11, whereby a relative approximate position of the stopping pawl body 50 with respect to the slider body 10*a* is temporarily determined. After that, the slider body 10*a* is covered with the cover body 30, and caulking is performed, whereby the slider 2 is assembled.

In the slider 2 of the second embodiment, the upper blade 11 of the slider body 10*a* does not have the recess portion 11*c* as in the first embodiment, and the insertion piece 25 as in the first embodiment is not provided in the stopping pawl body 50; therefore, the structures of the slider body 10*a* and the stopping pawl body 50 can be simplified in comparison with the slider 1 of the first embodiment. Even when the recess portion 11*c* and the insertion piece 25 of the first embodiment are not provided in the slider 2 of the second embodiment, the projecting portion 54 of the stopping pawl body 50 is stored and held in the pawl body holding portion 35 of the cover body 30 by the flat surface 11*a* of the upper blade 11 and the cover body 30; therefore, the stopping pawl body 50 is stably assembled on the slider body 10*a* at a predetermined position.

Furthermore, in the slider 2 of the second embodiment, as in the slider 1 of the first embodiment, since the stopping pawl body 50 swings with a contact surface between a flat surface of the upper blade 11, hardly affected by the working accuracy according to press molding, and the extending portion 53 of the stopping pawl body 50 as a fulcrum, a defect and failure of the stopping mechanism hardly occur, so that the stopping mechanism can be stably operated for a long period of time.

Third Embodiment

Figure 13:
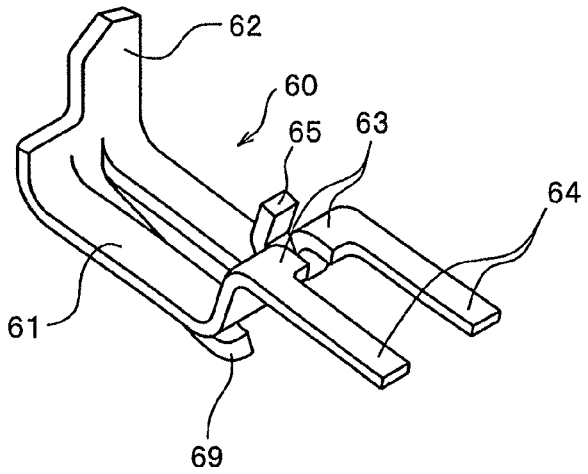
FIG. 13 is a perspective view showing a stopping pawl body of a slider provided with a stopping mechanism according to a third embodiment of the invention.
Figure 14:
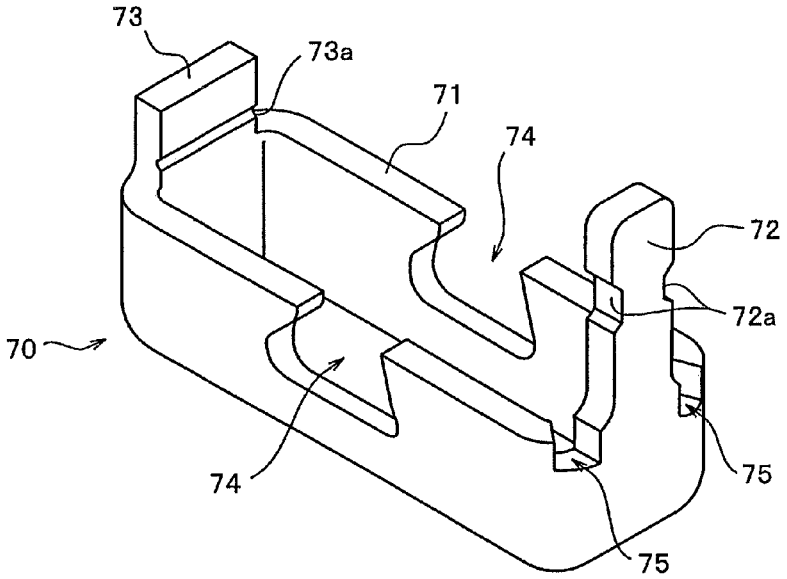
FIG. 14 is a perspective view showing a cover body of the slider.

FIG. 13 is a perspective view showing a stopping pawl body of a slider according to a third embodiment, and FIG. 14 is a perspective view showing a cover body of the slider.

The slider according to the third embodiment has a slider body 10, a tab 6 having an attaching shaft portion 7 at one end, a stopping pawl body 60 provided integrally with a resilient piece 69, and a cover body 70 mounted on the slider body 10. The slider body 10 and the tab 6 used in the slider of the third embodiment are configured similarly to those of the slider 1 according to a first embodiment.

The stopping pawl body 60 of the third embodiment has a main body 61 having a shape opening downward, a pawl portion 62 provided perpendicularly from a rear end of the main body 61, a pair of left and right extending portions 63 extending from a front end of the main body 61 and curved forward, left and right projecting portions 64 projecting forward from a tip portion of each of the extending portions 63, an insertion piece 65 provided perpendicularly from the front end of the main body 61, and a resilient piece 69 extending on the upper surface side of the main body 61. The stopping pawl body 60 is configured similarly to the stopping pawl body 20 of the first embodiment except that the projecting direction of the projecting portion 64 is directed forward.

A cover body 70 of the third embodiment has a box-shaped cover main body 71 whose lower side is opened and forward attaching piece 72 and rearward attaching piece 73 provided perpendicularly from a front end and a rear end of the cover main body 71. In left and right side wall portions of the cover main body 71, a notched tab holding portion 74 for holding the attaching shaft portion 7 of the tab 6 is formed, and in a front side wall portion of the cover main body 71, a notched pawl body holding portion 75 for holding the projecting portion 64 of the stopping pawl body 60 is formed.

In this case, the pawl body holding portion 75 is formed so that the projecting portion 64 of the stopping pawl body 60 is loosely fitted into the pawl body holding portion 75 (in other words, so that the projecting portion 64 is stored and held with a spatial allowance). In the forward attaching piece 72, constriction portions 72*a* partially reducing the width dimension of the forward attaching piece 72 are provided at the left and right side edge portions. In the rearward attaching piece 73, a recess groove portion 73*a* formed along the slider width direction is provided at the front surface.

When the slider of the third embodiment having the above configuration is assembled, the attaching shaft portion 7 of the tab 6 is placed on the upper blade 11 of the slider body 10, and the stopping pawl body 60 is further placed on the upper blade 11. At this time, the extending portion 63 of the stopping pawl body 60 is brought into contact with a flat surface 11*a* of the upper blade 11. The pawl portion 62 of the stopping pawl body 60 is inserted into the pawl hole 11*b* of the upper blade 11, and, at the same time, the insertion piece 65 of the stopping pawl body 60 is inserted into the recess portion 11*c* of the upper blade 11, whereby the position of the stopping pawl body 60 is temporarily determined. After that, the slider body 10 is covered with the cover body 70, and caulking is performed, whereby the slider is assembled.

In the slider of the third embodiment thus assembled, since the projecting portion 64 of the stopping pawl body 60 is held by the pawl body holding portion 75 of the cover body 70, the stopping pawl body 60 is stably assembled on the slider body 10 at a predetermined position in the slider width direction. The position in the slider length direction of the stopping pawl body 60 is controlled by the fact that the pawl portion 62 of the stopping pawl body 60 is inserted in the pawl hole 11*b* of the upper blade 11 and the fact that the insertion piece 65 of the stopping pawl body 60 is inserted into the recess portion 11*c* of the cover body 70.

In the slider of the third embodiment, as in the sliders 1 and 2 of the first and second embodiments, since the stopping pawl body 60 swings with a contact surface between the flat surface 11*a* of the upper blade 11, hardly affected by the working accuracy according to press molding, and the extending portion 63 of the stopping pawl body 60 as a fulcrum, a defect and failure of a stopping mechanism hardly occur, so that the stopping mechanism can be stably operated for a long period of time.

Fourth Embodiment

Figure 15:
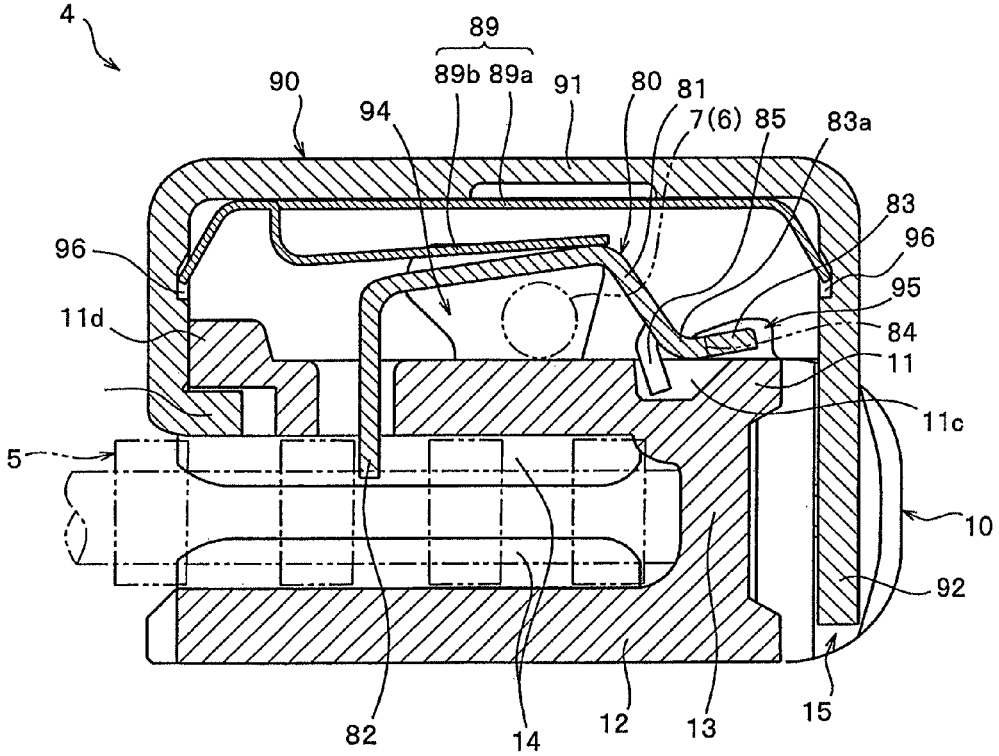
FIG. 15 is a cross-sectional view showing a slider provided with a stopping mechanism according to a fourth embodiment of the invention.
Figure 16:
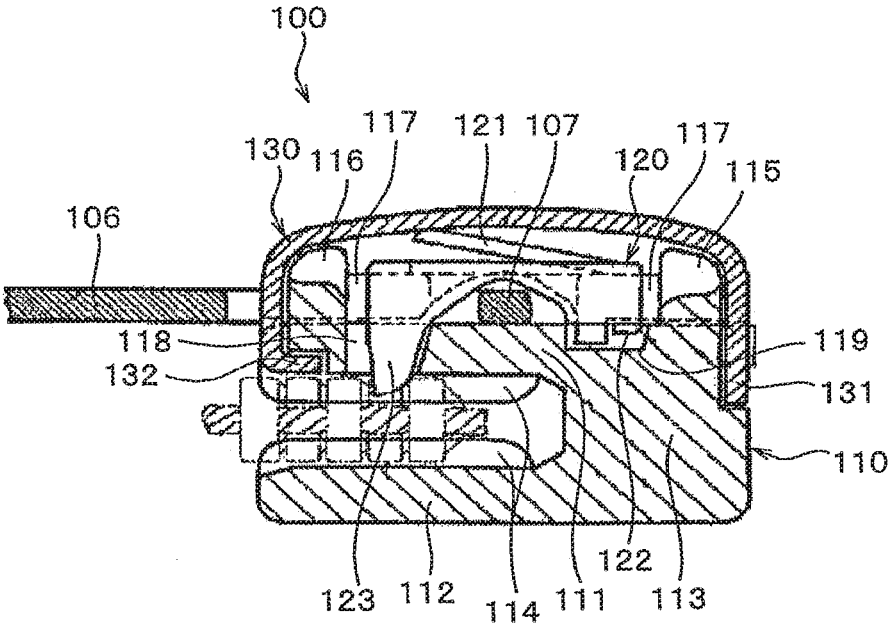
FIG. 16 is a cross-sectional view showing a conventional slider provided with a stopping mechanism.
Figure 17:
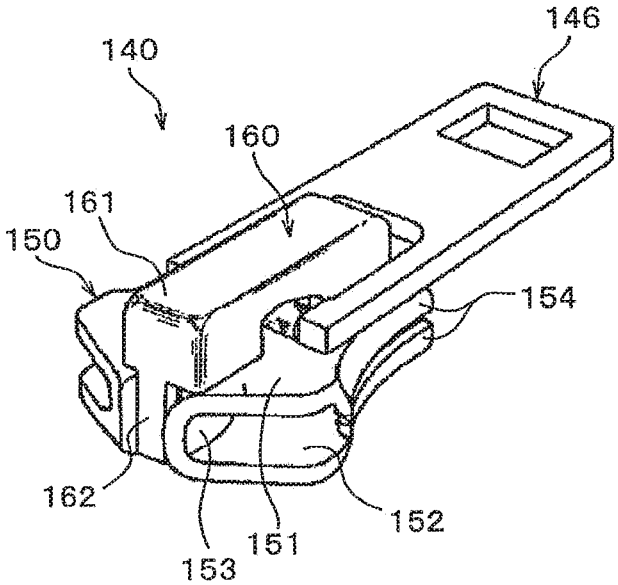
Prior Art FIG. 17
FIG. 17 is a perspective view showing another conventional slider provided with a stopping mechanism.
Figure 18:
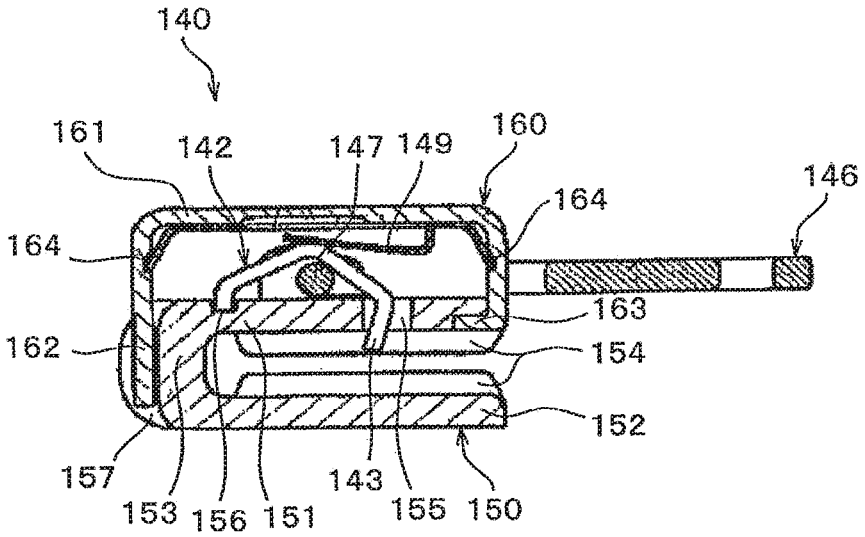
Prior Art FIG. 18
FIG. 18 is a cross-sectional view of the slider.

FIG. 15 is a cross-sectional view showing a slider according to a fourth embodiment.

A slider 4 according to the fourth embodiment has a slider body 10, a tab 6 having an attaching shaft portion 7 at one end, a stopping pawl body 80 having a pawl portion 82, a cover body 90 mounted on the slider body 10, and a resilient piece (resilient member) 89 formed separately from the stopping pawl body 80. The slider body 10 and the tab 6 in the fourth embodiment are configured similarly to those of the slider 1 according to the first embodiment.

The stopping pawl body 80 of the fourth embodiment has a main body 81 having a shape opening downward, a pawl portion 82 provided perpendicularly from a rear end of the main body 81, a pair of left and right extending portions 83 extending from a front end of the main body 81, projecting portions 84 projecting from a tip portion of each of the extending portions 83 toward outside in the horizontal direction, and an insertion piece 85 provided perpendicularly from the front end of the main body 81 so as to be held between the left and right extending portions 83. The stopping pawl body 80 is configured similarly to the stopping pawl body 20 of the first embodiment except that the resilient piece 29 formed integrally with the stopping pawl body 20 of the first embodiment is omitted.

The cover body 90 of the fourth embodiment has a box-shaped cover main body 91 whose lower side is opened and forward attaching piece 92 and rearward attaching piece 93 provided perpendicularly from a front end and a rear end of the cover main body 91. In left and right side wall portions of the cover main body 91, a tab holding portion 94 holding the attaching shaft portion 7 of the tab 6 and a pawl body holding portion 95 holding a projecting portion 84 of the stopping pawl body 80 are formed. Further, a resilient piece holding grooves 96 for holding the resilient piece 89 are formed in a front side inner wall surface and a rear side inner wall surface of the cover main body 91.

The resilient piece 89 of the fourth embodiment is assembled on the cover body 90 to resiliently press the stopping pawl body 80. The resilient piece 89 has a resilient piece main body 89*a* assembled on the cover body 90 and a resilient pressing portion 89*b* formed to be branched from a ceiling portion of the resilient piece main body 89*a*, and the resilient pressing portion 89*b* biases the stopping pawl body 80 so that the pawl portion 82 of the stopping pawl body 80 advances into an element guide passage 16 through a pawl hole 11*b* of the slider body 10.

When the slider 4 of the fourth embodiment having the above configuration is assembled, the resilient piece 89 is first held by being attached into the cover main body 91 of the cover body 90.

Specifically, the resilient piece 89 is inserted into the cover main body 91 of the cover body 90 while stress is applied to the resilient piece 89 to deflect the resilient piece main body 89*a*, and the resilient piece 89 is compressed so that the resilient piece main body 89*a* of the resilient piece 89 is in contact with a ceiling surface (inner wall upper surface) of the cover main body 91. According to this constitution, when a front end edge and a rear end edge of the resilient piece main body 89*a* reach the positions of the resilient piece holding grooves 96 of the cover main body 91, the resilient piece main body 89*a* resiliently returns to fit the front end edge and the rear end edge of the resilient piece main body 89*a* to the resilient piece holding grooves 96 of the cover main body 91; therefore, the resilient member is held in the cover main body 91.

While the resilient piece 89 is attached to the cover body 90, the attaching shaft portion 7 of the tab 6 and the stopping pawl body 80 are placed on an upper blade 11 of the slider body 10 in a procedure similar to that described in the first embodiment. After that, the slider body 10 on which the attaching shaft portion 7 of the tab 6 and the stopping pawl body 80 are placed is covered with the cover body 90 holding the resilient piece 89, and caulking is performed. According to this constitution, the slider 4 of the fourth embodiment is assembled.

In the slider 4 of the fourth embodiment thus assembled, since the projecting portion 84 of the stopping pawl body 80 is held in the pawl body holding portion 95 of the cover body 90 by a flat surface 11*a* of the upper blade 11 and the cover body 90, the stopping pawl body 80 is stably assembled on the slider body 10 at a predetermined position.

When the slider 4 of the fourth embodiment is in a state where the tab 6 is not operated, and the stopping pawl body 80 is not lifted by the attaching shaft portion 7 of the tab 6, the stopping pawl body 80 is biased by the resilient piece 89, and the pawl portion 82 is made to advance in an element guide passage 16 through the pawl hole 11*b* of the slider body 10, as shown in FIG. 15. According to this constitution, when the slider 4 is used in a slide fastener, a stopping mechanism can be operated.

Meanwhile, when the slider 4 is slid by operating the tab 6, the stopping pawl body 80 is lifted upward against the biasing force of the resilient piece 89 by the attaching shaft portion 7 of the tab 6; therefore, the stopping pawl body 80 entirely rotates with a contact surface of the extending portion 83, which is in contact with the flat surface 11*a* of the upper blade 11, as a fulcrum to retreat the pawl portion 82 from the element guide passage 16. According to this constitution, the stopping mechanism of the slider 4 is released, and the slider 4 can be freely slid along an element row of the slide fastener.

After that, when the sliding operation of the slider 4 is terminated, the stopping pawl body 80 is biased by the resilient piece 89, and the stopping pawl body 80 entirely rotates with the contact surface of the extending portion 83, which is in contact with the flat surface 11*a* of the upper blade 11, as a fulcrum to advance the pawl portion 82 into the element guide passage 16. Consequently, the stopping mechanism can be operated again.

Namely, even in the slider 4 of the fourth embodiment in which the stopping pawl body 80 and the resilient piece 89 are formed separately, since the stopping pawl body 80 can be swung in the direction in which the pawl portion 82 retreats from the element guide passage 16 and in the direction in which the pawl portion 82 advances into the element guide passage 16 with the contact surface in contact with the flat surface 11*a* of the upper blade 11 as a fulcrum, a defect and failure of the stopping mechanism hardly occur, so that the stopping mechanism can be stably operated for a long period of time.

DESCRIPTION OF REFERENCE NUMERALS

1, 2, 4 slider
5 element row
6 tab
7 attaching shaft portion
10, 10*a* slider body
11 upper blade
11*a* flat surface
11*b* pawl hole
11*c* recess portion
11*d* rearward engaging portion
12 lower blade
13 diamond
14 flange portion
15 engagement recess portion
16 element guide passage
20 stopping pawl body
21 main body
22 pawl portion
23 extending portion
23*a* curved portion
24 projecting portion
25 insertion piece
28 line
29 resilient piece
30 cover body
31 cover main body
32 forward attaching piece
32*a* constriction portion
33 rearward attaching piece
33*a* recess groove portion
34 tab holding portion
35 pawl body holding portion
40 cover body
41 cover main body
44 tab holding portion
45 pawl body holding portion
50 stopping pawl body
51 main body
52 pawl portion
53 extending portion
54 projecting portion
59 resilient piece
60 stopping pawl body
61 main body
62 pawl portion
63 extending portion
64 projecting portion
65 insertion piece
69 resilient piece
70 cover body
71 cover main body
72 forward attaching piece
72*a* constriction portion
73 rearward attaching piece
73*a* recess groove portion
74 tab holding portion
75 pawl body holding portion
80 stopping pawl body
81 main body
82 pawl portion
83 extending portion
84 projecting portion
85 insertion piece
89 resilient piece (resilient member)
89*a* resilient piece main body
89*b* resilient pressing portion
90 cover body
91 cover main body
92 forward attaching piece
93 rearward attaching piece
94 tab holding portion
95 pawl body holding portion
96 resilient piece holding groove

The invention claimed is:

1. A slider provided with a stopping mechanism, including:

a slider body;

a tab having an attaching shaft portion;

a stopping pawl body;

a resilient piece provided integrally with or separately from the stopping pawl body and pressing the stopping pawl body resiliently; and a cover body storing the stopping pawl body and the resilient piece inside and attached to the slider body, the stopping pawl body including a main body provided across the attaching shaft portion of the tab and a pawl portion extending from one end side of the main body and engageable with a fastener element on an element guide passage of the slider body, wherein the stopping pawl body further includes an extending portion and a projecting portion, wherein the extending portion extends from another end side of the main body extends in a direction approaching an upper blade of the slider body and is curved or bent in a direction of a shoulder opening of the slider body, and the projecting portion projects from a tip portion of the extending portion and is held by the cover body, the extending portion functions as a rotation support part which is in contact with an upper surface of the upper blade of the slider body and becomes a fulcrum when the stopping pawl body rotates, the rotating support part contacts at least a flat surface of the upper surface of the upper blade, and the cover body comprises a pawl body holding portion holding the projecting portion of the stopping pawl body.

2. The slider provided with a stopping mechanism according to claim 1, wherein the flat surface is a main surface of the upper blade.

3. The slider provided with a stopping mechanism according to claim 1, wherein the projecting portion of the stopping pawl body is stored and held in the pawl body holding portion of the cover body.

4. The slider provided with a stopping mechanism according to claim 1 wherein a recess portion is provided on the upper surface side of the upper blade, and the stopping pawl body includes an insertion piece provided perpendicularly from the another end side of the main body and inserted into the recess portion of the upper blade.

5. The slider provided with a stopping mechanism according to claim 4, wherein a pair of the extending portions and a pair of the projecting portions are provided, and the insertion piece is provided between the pair of the extending portions and between the pair of the projecting portions.

6. The slider provided with a stopping mechanism according to claim 1 wherein the tip portion of the extending portion is spaced apart from the upper blade when the tab is not operated.

7. The slider provided with a stopping mechanism according to claim 1 wherein the projecting portion of the stopping pawl body projects from the tip portion of the extending portion in a slider width direction, and the pawl body holding portion is formed at left and right side wall portions of a cover main body in the cover body.

* * * * *